United States Patent [19]

Rao

[11] 4,421,717

[45] Dec. 20, 1983

[54] METHOD OF MAKING WEAR RESISTANT FERROUS BASED PARTS

[75] Inventor: Vemulapalli D. N. Rao, Bloomfield Township, Oakland County, Mich.

[73] Assignee: Ford Motor Company, Dearborn, Mich.

[21] Appl. No.: 405,136

[22] PCT Filed: Jun. 10, 1982

[86] PCT No.: PCT/US82/00789

§ 371 Date: Jun. 10, 1982

§ 102(e) Date: Jun. 10, 1982

[51] Int. Cl.[3] ..... B22F 3/12

[52] U.S. Cl. ..... 419/27; 419/36; 419/53

[58] Field of Search ..... 419/23, 27, 36, 38, 419/53

[56] References Cited

U.S. PATENT DOCUMENTS

| | | | |
|---|---|---|---|
| 2,299,192 | 10/1942 | Tormyn | 75/22 |
| 2,775,531 | 12/1956 | Montgomery | 427/423 |
| 3,684,498 | 8/1972 | Heck | 419/6 |
| 3,743,556 | 7/1973 | Breton et al. | 419/27 |
| 3,929,476 | 12/1975 | Kirby, Jr. et al. | 419/27 |
| 4,035,159 | 7/1977 | Hashimoto et al. | 75/246 |
| 4,062,678 | 12/1977 | Breyer et al. | 428/546 |
| 4,124,737 | 11/1978 | Wolfla et al. | 75/235 |
| 4,147,074 | 4/1979 | Noguchi et al. | 75/148 |
| 4,158,689 | 6/1979 | Pett et al. | 264/63 |

OTHER PUBLICATIONS

Hausner, *Handbook of Powder Metallurgy,* Chemical Publishing Co., N.Y., (1973) p. 14.

*Primary Examiner*—Brooks H. Hunt
*Assistant Examiner*—Anne Brookes
*Attorney, Agent, or Firm*—Joseph W. Malleck; Olin B. Johnson

[57] ABSTRACT

A method is disclosed for making wear resistant, ferrous based parts (10) by molding a uniform mixture of ferrous based powder and binder material into a compacted shape, heating the compacted shape to remove the binder and to partially sinter the mixture to a strength of 1000–8000 psi, while maintaining a porosity of 20–40% at least along the outer region of the part, depositing a fluid suspension of wear resistant particles onto a surface zone of the shape, and heating the coated shape to bond the particles to the surface and fully sinter the part.

19 Claims, 1 Drawing Figure

METHOD OF MAKING WEAR RESISTANT FERROUS BASED PARTS

RELATED APPLICATIONS

A corresponding PCT application, PCT/US82/00789, has been filed.

BACKGROUND OF THE INVENTION AND PRIOR ART STATEMENT

Rocker arms, valve guide sleeves, and other high wear parts for an engine have typically been made of solid material and in the case of rocker arms have usually been castings comprised of cast iron. These iron parts have required costly post-treatment, such as furnace heating, to improve wear characteristics. In the hope of reducing cost and weight, other materials have been substituted for the solid castings, such as sheet metal stampings. The substituted materials have shown poor wear along with low strength and low durability. When aluminum was substituted for the iron castings, special precautions had to be made to control the quantity of alloying ingredients, such as silicon, and the addition of lubricating substances, such as tin and lead, in order to achieve a reasonable degree of wearability (see U.S. Pat. No. 4,147,074).

In recent years vehicle manufacturers have turned to powder metal parts in the hope of reducing the processing costs, but have not been able to achieve high wear resistance in such parts. They have thus relegated powder metal to applications of low to moderate wear. For powdered parts to be utilized in critical applications, such as in valve seats, the powdered metal was made of a high alloy content material and the particles were agglomerated in conventional fashion (see U.S. Pat. No. 4,062,678 and 4,035,159). Each of these patents fail to exhibit superior surface wear resistance as demanded by critical engine applications today.

In the past, coatings have been applied to powdered metal parts to improve surface conditions, but in each instance the process involved multiple sintering steps with interposed coating steps, the coatings not being of a particularly low friction characteristic and typically were of a smearable type characterized by the group including copper, tin, zinc and lead (see U.S. Pat. No. 3,684,498 and 2,299,192). Techniques used in related arts to apply coatings to powdered metal parts have included plasma spraying of a melted alloy to obtain adherence by impact and high temperature bonding. Such spraying has usually been carried out on solid finished parts to obtain proper bonding. Plasma spraying suffers from high cost and the necessity for a post grinding operation. Another technique casts-in-place an equivalent to a coating about a desired part. Unfortunately, such cast-in-place coatings have not necessarily maintained successful adherence under service and have suffered from delamination. Moreover, such coatings undergo different shrinkage than the main body of the casting.

SUMMARY OF THE INVENTION

The invention is a method of making a wear resistant, ferrous based part by: (a) molding a uniform mixture of ferrous based powder and binder material into a compacted shape; (b) heating said compacted shape to remove said binder material and to partially sinter said mixture to a strength of about 1000–8000 psi, while maintaining a porosity of 20–40% at least along the outer region of said part; (c) depositing a fluid suspension of wear resistant powder particles onto at least a selected surface zone of said partially sintered shape, said particles coating said zone and permeating the surface region of said zone by absorption as permitted by said porosity; and (d) heating said coated shape to remove said fluid, to bond said particles to said shape, and to fuse said powder and particles together to define said part.

Preferably, step (a) may be carried out with one or more of the following features: by mixing the ferrous powder and binder material in a ratio of 70/30% by weight, mechanically mixing the powder and a thermoplastic binder for 15–20 minutes at a temperature of 300°–350° F., by forming the mixture into pellets, constituting the ferrous powder of SAE 52100 steel, controlling the particle size of the mixture to have at least a 35% volume fraction which is −325 mesh and, more particularly, controlling the particle distribution of the mixture to substantially 3–5% as +150, 20–30% as +230, 15–25% as −230+270, 15–20% as +270−325, and 35% as −325 mesh.

Preferably, step (b) may be carried out by heating to the range of 1700°–2150° F. (926°–1176.7° C.) for 10–30 minutes, use of a nitrogen atmosphere, and controlling the heatup in increments, advantageously from room temperature to 300° F. in one hour, 300°–450° F. in one hour, 450°–1950° F. in two hours, and 1950°–2150° F. in one-quarter hour.

Preferably, step (c) may be carried out by selecting the particles to have an average particle size of less than 10 microns, of a material with a hardness of RC-55, a thermal expansion mismatch of less than $4\times10^{-6}$ in-/in/°F. with steel, and a coefficient of friction of less than 0.1 against lubricated cast iron or hardened steel. Advantageously, the particles are selected from the group consisting of $Cr_2O_3$, $Al_2O_3$ and SiC, and including a binder material selected from the group consisting of cobalt, nickel or equivalent brazing material. Alternatively, the particles may advantageously be an alloy consisting of by weight 45–70% cobalt, 28–48% Mo, 2–10% Si and 0.5–10% Cr.The particles may preferably be sprayed on as an aqueous slurry or dipped, using such slurry. The coating may be applied to provide a resulting thickness of 5–20 mil (0.005–0.020 inch). The coating may be applied in increments of 0.5 mil, with the final increment producing a thickness of about 0.020 inch. The particles may be controlled as to size by ball milling with media consisting essentially of either SiC or chromium containing steel along with 0.5 gram of methyl cellulose per 100 grams of the said particle in 100 cc of water.

Preferably, step (d) may be carried out by rapidly heating to 2000° F. (1093.3° C.) and holding for 15–20 minutes and then to 2150° F. (1148.9° C.) and holding for 0.5–1.0 hours. It would be advantageous to carry out the heating in a dry hydrogen atmosphere (−70° F. dew point) and to slowly cool the heated shape to the room temperature in a period of 4–10 hours.

DETAILED DESCRIPTION

Figure 1:
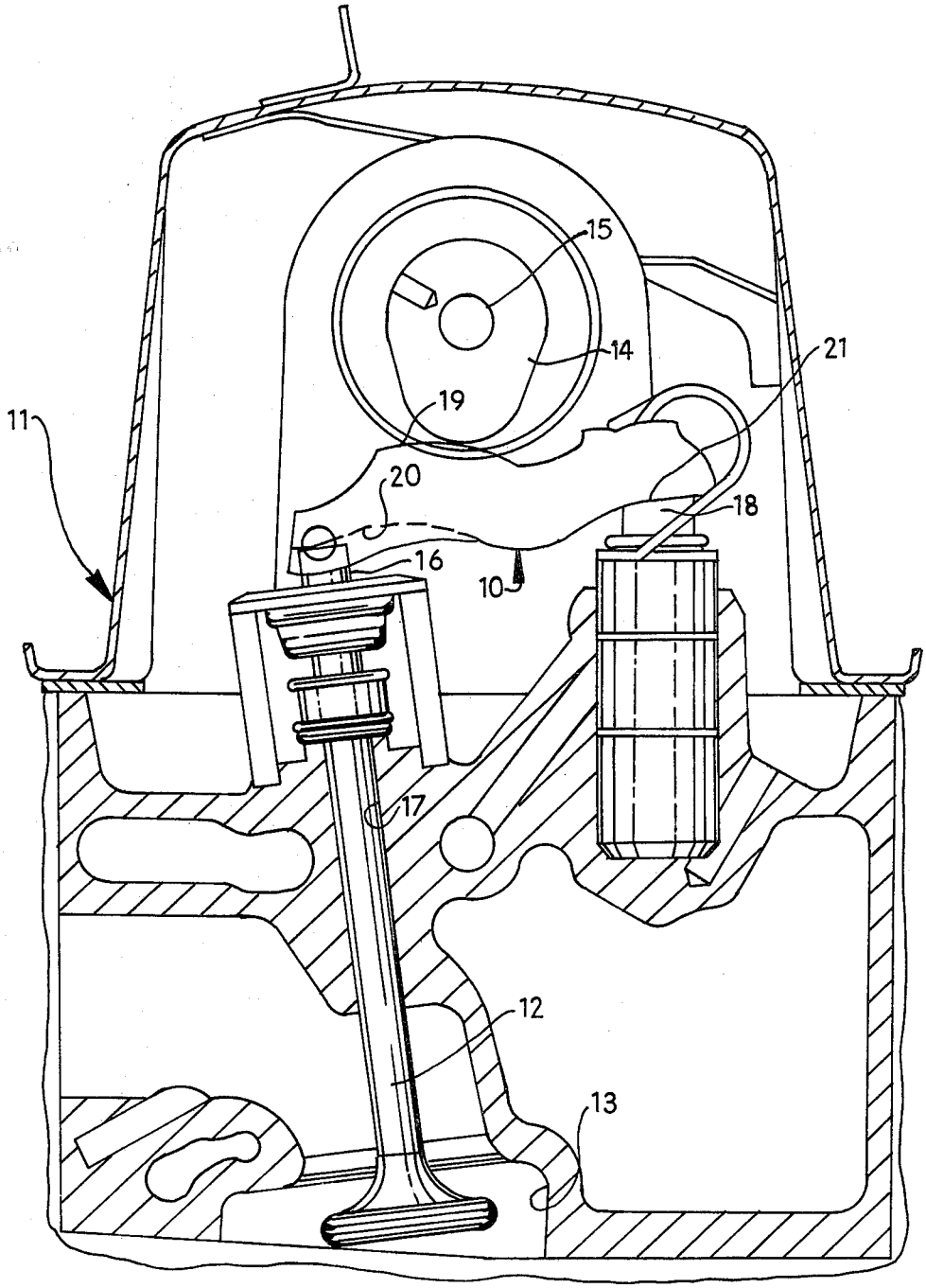
FIG. 1 is a fragmentary sectional elevational view of a portion of an engine illustrating the use of a wear resistant, ferrous based part made in accordance with the method of this invention.

The type of wear resistant part, for which this invention is particularly adapted, is a rocker arm 10. The arm is shown in FIG. 1 as part of an engine head assembly 11, wherein a valve 12 is designed to control the egress of exhaust gases from a cylinder chamber 13. The rocker arm 10 is used to transfer rotary motion from a cam 14, carried by shaft 15, to a valve stem 16 which undergoes reciprocal motion within valve guide 17. The arm 10 pivots about a hydraulically cushioned fulcrum 18. The wear surfaces on the arm 10 (which engage moving surfaces) include exterior surface 19 and interior surfaces 20 and 21.

To form such wear resistant surfaces on the rocker arm by an inexpensive process which promotes durability, the following preferred process mode is utilized. The process comprises four essential steps: (a) molding a uniform mixture of ferrous based powder and binder material into a compacted shape; (b) heating said compacted shape to remove said binder material and to partially sinter said mixture to a strength of about 1000–8000 psi, while maintaining a porosity of 20–40% at least along the outer region of said part; (c) depositing a fluid suspension of wear resistant powder particles onto at least a selected surface zone of said partially sintered shape, said particles coating said zone and permeating the surface region of said zone by absorption as permitted by said porosity; and (d) heating said coated shape to remove said fluid, to bond said particles to said shape, and to fuse said powder and particles together to define said part.

In more particularity, the first step of molding and forming a compacted shape is preferably carried out by mixing a steel powder of SAE designation 52100 having a particle size which has at least a 35% volume fraction of −325 mesh. A typical screen analysis of such steel powder would consist generally of 3–5% as +150 mesh, 20–30% as −150+230 mesh, 15–20% as −230+270 mesh, 15–20% as −270+325 mesh, and at least 35% as −325 mesh. The steel powder is mixed with a binder material in a proportion preferably 70/30% by weight. The binder may be of an organic type specifically set forth in U.S. Pat. No. 4,158,689, the disclosure of which is incorporated herein by reference.

For purposes of the preferred embodiment, a binder is used consisting essentially of 50% by volume KRATON 1101 tryblock polymer which is a thermoplastic elastomer produced by Shell Chemical Company; 16.7% Styron 545, a material produced by Dow Chemical Company which is a block polymer added to improve strength; and 33.3% Shellflex 371, a plasticizer produced by Shell Chemical Company.

The mixture is worked to a dough consistency and pelletized. Working may be carried out in a Banbury mixer for 15–30 minutes, at a temperature level of about 300°–315° F. Pelletizing may be carried out in a conventional pelletizer and shredded into approximately $\frac{1}{8}$–$\frac{1}{4}$ inch chips after cooling. The shredded or chopped material is then extruded into $\frac{1}{8}$ inch diameter strings and chopped to $\frac{1}{8}$ inch lengths. This operation is repeated at least twice to ensure uniform mixing. The $\frac{1}{8}$ diameter $\times\frac{1}{8}$ inch long chips are then fed as stock material into the mold to complete the molding operation. The mold is designed to provide proper tolerances to compensate for firing shrinkage, rapid heating, flash removal, and for quick chill to facilitate ejection from the mold.

The second step concerning partial sintering is carried out by heating to 1700°–2150° F. (926°–1176.7° C.) in a nitrogen atmosphere for 15–30 minutes. A typical heating and cooling cycle for this step comprises the following increments: (a) heat from room temperature to 300° F. in one hour, (b) heat from 300°–450° F. for one hour, (c) heat from 450°–1950° F. for two hours, and (d) heat from 1950°–2100° F. for 15 minutes. The molded material is then rapidly cooled to room temperature. The early stages of this cycle is to remove the binder material and the last stage is to partially sinter the molded shape. It is important to point out that the heating of this step does reach sintering temperatures of 1800°–2150° F., but the shape is exposed to such temperatures for a period of time which is short,i.e., 10–30 minutes and preferably 10–20 minutes. Thus only partial sintering is achieved.

Alternatively, the binder material can be removed in a separate heating operation if deemed advantageous. In such case removal would be accomplished by heating in a nitrogen atmosphere to 1500° F. and holding for at least one-half hour at such temperature followed by rapid cooling. In many cases the molded parts, after such a binder removal procedure, lose adequate strength for handling. This is permissible in cases where no subsequent machining is required before full sintering, such as the rocker arm 10 shown in FIG. 1.

The third step of depositing particles is preferably carried out by spraying a diluted aqueous slurry containing hard wear resistant particles of a material having a hardness of at least RC-55, a thermal expansion mismatch of less than $4\times10^{-6}$ in/in/°F. with steel, and a coefficient of friction less than 0.1 against oil lubricated cast iron or hardened steel. Spraying is carried out to ensure a predetermined thickness in the surface region coated while allowing for absorption. Alternatively, the deposition can be carried out by dipping the shape into a slurry of said particles.

The wear resistant particles may be selected from the group consisting of $Cr_2O_3$, SiC, $Al_2O_3$, and including a binder material (up to 10% by weight) selected from the group consisting of cobalt, nickel or equivalent brazing material. Silicon metal powder can also be used but does not require a binder material and sintering is carried out in nitrogen or a mixture of nitrogen and hydrogen. Alternatively, the particles can be comprised of an alloy consisting essentially of by weight 45–70% cobalt, 28–48% molybdenum, 2–10% silicon, and 0.5–10% chromium. The wear resistant particles may have an average particle size of 10 microns or less, or optimally 3–5 microns.

The coating particles may be prepared for application by ball milling, using silicon carbide or chromium containing steel as milling media along with about 0.5 gram of methyl cellulose per 100 grams of particles in 100 cc's of water. The ball milling can be carried out for approximately 15–30 minutes to provide uniform milling and blending.

The coating may be deposited in increments, with a first increment of about 0.5 mil (0.0005 inch) thick, then dried, and other increments repeated until approximately the range of 0.002–0.020 inches thick, preferably 0.005–0.02 inches, or other appropriate thickness is achieved for application. In the case of the rocker arm, a coating thickness of about 0.010 inches was attained using the high performance alloy particles with 5% by weight of a nickel/chrome brazing binder. The as-deposited average particle size of such slurry was about 8 microns. Using the materials selected as part of this invention, such coated surfaces have proved to be sufficiently smooth in texture after drying in an oven and have adequate strength to withstand the handling sequence, particularly during subsequent sintering.

In the last step, sintering of the coated parts is preferably carried out in a dry hydrogen atmosphere (−70° F. dew point) by rapidly heating to 2000° F. and holding for 15–20 minutes, then raising the temperature of the sintering furnace to 2150° F. and holding for at least one-half hour, preferably about one hour. The sintered shapes are then slowly cooled to room temperature over a period of about 4–10 hours. The longer cooling period is required, particularly in the case of coating thicknesses which exceed 5 mils (0.005 inch), to avoid spalling. For parts having a coating thickness less than 5 mils, the cooling sequence can be modified by reducing the cooling time to 1–2 hours.

As an alternate method of carrying out the final step, the coating in step (c) may be of elemental silicon metal and the sintering step is carried out to provide a chemical reaction between a nitrogen atmosphere or a mixture of nitrogen and hydrogen and the silicon coating. The nitrogen typically would be not less than 5% by volume of the atmosphere. The shape would be rapidly heated to 1850° F. for a period of about 2-½ hours, then gradually heated to 1850°–2150° F. for a period of about 2 hours (held at this temperature for ½ hour), and then slowly cooled to room temperature over a period of about 10 hours. Rapid cooling is avoided to prevent cracking and spalling of the coating.

I claim:

1. A method of making a wear resistant, ferrous based part, comprising the steps of:

(a) molding a uniform mixture of ferrous based powder and binder material into a compacted shape;

(b) heating said compacted shape to remove said binder material and to partially sinter said mixture to a strength of about 1000–8000 psi, while maintaining a porosity of 20–40% at least along the outer region of said part;

(c) depositing a fluid suspension of refractory wear resistant powder particles onto at least a selected surface zone of said partially sintered shape, said particles coating said zone and permeating the surface region of said zone by absorption as permitted by said porosity; and (d) heating said coated shape to remove said fluid, to bond said particles to said shape, and to fuse said powder and particles together to define said part.

2. The method as in claim 1, in which in step (a) said ferrous based powder and binder are mixed in a ratio of about 70/30% by weight.

3. The method as in claim 1, in which in step (a) said ferrous powder is constituted of SAE 52100 steel particles.

4. The method as in claim 1, in which in step (a) said mixture is formed into pellets prior to being molded to form said compacted shape.

5. The method as in claim 1, in which in step (b) said heating is carried out in the range of 1700°–2150° F. (926°–1176.7° C.) for a period of 15–30 minutes.

6. The method as in claim 1, in which in step (b) said heating is carried out in the range of 1950°–2150° F. (926°–1176.7° C.) and in a nitrogen atmosphere with the total heatup period being about 2–6 hours.

7. The method as in claim 1, in which in step (b) said heating is carried out in increments, with a first increment from room temperature to 300° F. for about one hour, a second increment from 300°–450° F. for about one hour, a third increment from 450°–1950° F. for about two hours, and a last increment from 1950°–2150° F. for about one-quarter hour, said partial sintering taking place during said last increment and the removal of said binder being accomplished substantially during the other increments.

8. The method as in claim 1, in which in step (c) said wear resistant powder particles are selected of a material to have a hardness value of at least RC-55, a thermal expansion mismatch of less than $4\times10^{-6}$ in/in/°F., and a coefficient of friction of less than 0.1 against lubricated cast iron or hardened steel.

9. The method as in claim 1, in which in step (c) said depositing is carried out by spraying an aqueous slurry of said wear resistant particles onto said zone.

10. The method as in claim 1, in which in step (c) said depositing is carried out by dipping said partially sintered shape into a slurry containing said wear resistant particles.

11. The method as in claim 1, in which in step (c) said depositing is carried out to provide a coating thickness in the range of 2–20 mils (0.002–0.020 inch).

12. The method as in claim 1, in which in step (c) said wear resistant particles are selected from the group consisting essentially of $Cr_2O_3$, $Al_2O_3$ and SiC, and including a binder material selected from the group consisting of cobalt, nickel or equivalent brazing material.

13. The method as in claim 1, in which in step (c) said depositing is carried out in sequential increments, the final increment providing a resulting thickness of about 0.010 inch.

14. The method as in claim 1, in which in step (c) the wear resistant particles have an average particle size of 10 microns or less.

15. The method as in claim 1, in which in step (c) the wear resistant particles are comprised of an alloy consisting essentially of by weight 45–70% cobalt, 28–48% molybdenum, 2–10% Si, and 0.5–10% Cr.

16. The method as in claim 1, in which in step (c) said wear resistant particles are prepared by ball milling with media consisting essentially of either silicon carbide or chromium containing steel, along with 0.5 gram of methyl cellulose per 100 grams of particles in 100 cc's of water.

17. The method as in claim 1, in which in step (d) heating is carried out by rapidly heating to 2000° F. (1093.3° C.) and holding for 15–30 minutes, then raising to the temperature of 2100° F. (1148.9° C.) for about one hour.

18. The method as in claim 1, in which in step (d) heating is carried out in a dry hydrogen atmosphere (−70° F. dew point).

19. The method as in claim 1, in which the resulting heated coated shape of step (d) is slowly cooled for a period of 4–10 hours.

* * * * *